US011280469B2

(12) United States Patent
Epmeier et al.

(10) Patent No.: US 11,280,469 B2
(45) Date of Patent: Mar. 22, 2022

(54) RETROFIT LIGHTING DEVICE WITH IMPROVED THERMAL PROPERTIES

(71) Applicant: Lumileds LLC, San Jose, CA (US)

(72) Inventors: Matthias Epmeier, Aachen (DE); Bernd Schoenfelder, Aachen (DE); Marcus Jozef Henricus Kessels, Echt (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/246,393

(22) Filed: Apr. 30, 2021

(65) Prior Publication Data

US 2021/0348738 A1 Nov. 11, 2021

Related U.S. Application Data

(60) Provisional application No. 63/021,314, filed on May 7, 2020.

(30) Foreign Application Priority Data

May 7, 2020 (EP) ..... 20173445

(51) Int. Cl.
*F21S 45/47* (2018.01)
*F21V 29/70* (2015.01)
*F21S 41/162* (2018.01)

(52) U.S. Cl.
CPC ..... *F21S 45/47* (2018.01); *F21V 29/70* (2015.01); *F21S 41/162* (2018.01)

(58) Field of Classification Search
CPC ..... F21S 45/47; F21S 41/162; F21V 29/70
See application file for complete search history.

(56) References Cited

U.S. PATENT DOCUMENTS 7,420,268 B2 * 9/2008 Chen ..... F21K 9/00 257/686
2016/0290585 A1 10/2016 Lee et al.
2020/0084889 A1 3/2020 Epmeier et al.

FOREIGN PATENT DOCUMENTS

WO 2015/032896 A1 3/2015

OTHER PUBLICATIONS

The extended European Search Report corresponding to EP20173445.6, dated Oct. 27, 2020, 8 pages.

* cited by examiner

*Primary Examiner* — Thomas M Sember

(57) ABSTRACT

A lighting device (1) is provided comprising a support structure (13) extending from a heat sink (10) and comprising a mounting section (14) with a central mounting face (14.2), first and second lateral mounting faces (14.1, 14.3), and at least one heat dissipation member (18*a*, 18*b*) extending from an outer face (11*a*.1, 11*a*.3) of the support structure (13) comprising a respective one of the first and the second lateral mounting faces (14.1, 14.2), the at least one first heat dissipation member (18*a*, 18*b*) comprising an inclined surface (19*a*, 19*b*) which is inclined with respect to the respective one of the first and the second lateral mounting faces (14.1, 14.3) such that a thickness of the at least one first heat dissipation member (18*a*, 18*b*) increases along a direction (40) away from the mounting section (14).

20 Claims, 6 Drawing Sheets

RETROFIT LIGHTING DEVICE WITH IMPROVED THERMAL PROPERTIES

CROSS REFERENCE TO RELATED APPLICATIONS

This application claims benefit of priority to U.S. Provisional Application No. 63/021,314 filed May 7, 2020, and European Patent Application No. 20173445.6 filed May 7, 2020, each of which are incorporated by reference in this application in its entirety.

FIELD OF THE INVENTION

The present disclosure relates to a lighting device comprising a support structure extending from a heat sink and at least one first heat dissipation member for supporting the function of the heat sink, to a method of manufacturing the lighting device, and to an automotive headlight comprising the lighting device.

BACKGROUND OF THE INVENTION

Lighting devices such as halogen lamps have been standard light sources for automotive headlights for many years. However, recent advances in LED technology with concomitant new design possibilities and energy efficiency has spurred interest in finding suitable replacements for halogen lamps based on LED technology, such replacement being often referred to as LED retrofit.

While LED retrofits have become popular in recent years, capabilities of LED retrofits in mimicking halogen lamps are not yet optimal. For example, differing geometries of light emission regions of halogen lamps (filament) and e.g. LED dies (light emission surfaces) may cause difficulties when LED dies are used for mimicking the light emission of a halogen lamp not only in the near field but also in the far field.

In particular, mounting areas for LEDs in current LED retrofits and accordingly light emitting areas of such current LED retrofits are relatively large as compared e.g. to a surface of a volume encompassing a light emitting filament of a standard halogen lamp. Such LED retrofits are in particular therefore not suitable e.g. for automotive applications as their light emission properties are not in accordance with corresponding requirements.

While in particular the problem of the size of such large light emitting areas can be ad-dressed by arranging corresponding LEDs within a smaller volume, such approach is hampered by a heat density which dramatically increases when decreasing mutual distances between the LEDs.

SUMMARY OF THE INVENTION

It is thus an object of the present invention to provide a lighting device which is on the one hand provided with an improved capability to mimic light emission properties of a conventional halogen lamp and which on the other hand is provided with an improved capability to cope with large heat densities. It is yet a further object of the invention to provide a method of manufacturing the lighting device.

According to a first aspect of the present invention, a lighting device is provided comprising a support structure extending from a heat sink and comprising a mounting section with a central mounting face and first and second lateral mounting faces, wherein each of the first and second lateral mounting faces is adjacent to the central mounting face and forms an angle with the central mounting face; a first arrangement of at least two light emitting elements arranged along a mounting direction on the central mounting face; a second arrangement of at least two light emitting elements arranged along the mounting direction on the first lateral mounting face; a third arrangement of at least two light emitting elements arranged along the mounting direction on the second lateral mounting face; and at least one first heat dissipation member extending from an outer face of the support structure comprising a respective one of the first and the second lateral mounting faces, the at least one first heat dissipation member comprising an inclined surface which is inclined with respect to the respective one of the first and the second lateral mounting faces such that a thickness of the at least one first heat dissipation member increases along a direction away from the mounting section.

According to a second aspect of the present invention, a method of manufacturing such lighting device is provided, the method comprising providing a support structure extending from a heat sink and comprising a mounting section with a central mounting face and first and second lateral mounting faces, wherein each of the first and second lateral mounting faces is adjacent to the central mounting face and forms an angle with the central mounting face; providing a first arrangement of at least two light emitting elements arranged along a mounting direction on the central mounting face; providing a second arrangement of at least two light emitting elements arranged along the mounting direction on the first lateral mounting face; providing a third arrangement of at least two light emitting elements arranged along the mounting direction on the second lateral mounting face; and providing at least one first heat dissipation member extending from an outer face of the support structure comprising a respective one of the first and the second lateral mounting faces, the at least one first heat dissipation member comprising an inclined surface which is inclined with respect to the respective one of the first and the second lateral mounting faces such that a thickness of the at least one first heat dissipation member increases along a direction away from the mounting section.

According to a third aspect of the present invention, an automotive headlight is provided comprising the lighting device according to the first aspect.

Embodiments of a first, a second and a third aspect of the invention may have one or more of the properties described below.

In an embodiment of the invention, the heat sink is a member comprising or essentially consisting of metal, whereby "essentially consisting of" is to be understood as consisting predominantly of such metal (in an embodiment at least 90%) and possibly including further materials such as impurities or the like. In an embodiment, the metal is copper and/or aluminum. In an embodiment, the heat sink is a passive heat exchanger that transfers the heat generated by the respective arrangements of at least two light emitting elements that is transferred from the light emitting elements to the heat sink in particular via the support structure away, e.g. to a fluid medium such as air.

In an embodiment, the light emitting elements of the first, the second and the third arrangements of light emitting elements are light emitting diodes (LEDs), in particular LED dies. Employing LEDs is advantageous in terms of efficiency (light output power vs. electrical power consumption) and in that for example a light color can be suitably chosen for a particular application.

In an embodiment, the support structure extending from the heat sink is configured to transfer heat from the LEDs to the heat sink, and to this end, in an embodiment, the support structure comprises or essentially consists of metal, in particular copper or aluminum.

In an embodiment, the mounting section is an essentially longitudinal component, in an embodiment of essentially cuboidal shape. Being comprised by the support structure, in an embodiment, the mounting section comprises or essentially consists of a metal, in particular of copper or aluminum. Forming an angle with the central mounting face, in an embodiment, means the first and the second lateral mounting faces are arranged mutually parallel and form an angle of 90°±5° with the central mounting face. In an embodiment, the first and second lateral mounting faces thus are arranged mutually opposite of each other.

In an embodiment, the at least one first heat dissipation member corresponds to or comprises a separate member made of metal, in particular of copper or aluminum. While in an alter-native embodiment, the at least one first heat dissipation member is formed integrally with the support structure, it turned out to be advantageous to provide the at least one first heat dissipation member as a separate component as in this way, the first heat dissipation member can advantageously be designed in accordance with heat dissipation requirements, i.e. can be designed to optimally support guiding away heat generated by the light emitting elements of the first, second and third arrangements. In particular by being provided with the inclined surface and having a thickness that increases in a direction away from the mounting section, the at least one first heat dissipation member not only advantageously supports the function of the heat sink in guiding away heat generated by the light emitting elements, but also allows for a distribution of light emitted from the corresponding light emitting elements to advantageously mimic a light distribution of a filament of a standard halogen lamp. In particular, such shape of the first heat dissipation member may avoid any essential absorption of light emitted from the light emitting elements of the first, second and third arrangements.

In an embodiment, a proximal edge of the at least one first heat dissipation member is arranged essentially adjacent to the second or third arrangement of at least two light emitting elements corresponding to the respective one of the first and the second lateral mounting faces comprised by the outer face of the support structure from which the at least one first heat dissipation member extends. It is noted that "being arranged essentially adjacent to" the second or third arrangement of at least two light emitting elements is to be understood such that the proximal end may be arranged directly adjacent to the corresponding light emitting elements or such that a small gap may be present between the respective light emitting elements and the proximal end. In an embodiment, a width of the gap is 0.1 to 3 mm, in particular 0.1 to 1 mm. By thus arranging the at least one first heat dissipation member in close proximity with the light emitting elements, it becomes advantageously possible to efficiently guide away heat generated by the respective light emitting elements. The function of the at least one first heat dissipation member thus advantageously contributes to the effect of the heat sink which usually is arranged relatively far away from the light emitting elements (i.e. from the heat sources).

In an embodiment, the at least one first heat dissipation member is mounted in direct contact with the support structure. For example, the at least one first heat dissipation member may be connected with the support structure by applying solder paste. Alternatively, or in addition, the at least one first heat dissipation member is in an embodiment mounted in direct contact with the support structure using a pick and place process and/or using a reflow process. Using such processes for mounting the at least one first heat dissipation member turned out to enable a very accurate placement in combination with a provision of a good thermal interface.

In an embodiment, the outer face of the support structure from which the at least one first heat dissipation member extends comprises a first surface portion and a second surface portion separated from the first surface portion by a step, wherein the second surface portion comprises the respective one of the first and the second lateral mounting faces, and wherein the proximal edge of the at least one first heat dissipation member is arranged on the second surface portion. It advantageously turned out that the shape of the outer face comprising the step (which thus may be referred to as "mounting step") supports a precise and reliable mounting of the at least one first heat dissipation member.

In an embodiment, the inclined surface extends from the proximal edge of the at least one first heat dissipation member to a distal edge of the at least one first heat dissipation member, wherein the at least one first heat dissipation member comprises an essentially triangular cross-section with one corner of the triangular cross-section being formed by the proximal edge and with a side of the triangular cross-section opposing said corner forming the distal edge. Thereby, the essentially triangular cross-section is in an embodiment a cross-section of the at least one first heat dissipation member perpendicular to the mounting direction. As noted before, the outer face of the support structure from which the at least one first heat dissipation member extends comprises said mounting step. Thus, "essentially triangular" is to be understood that in particular one side of the cross-section in contact with the outer face of the support structure from which the at least one first heat dissipation member extends may comprise a step corresponding to the mounting step in between the first and second surface portions.

It turned out that in particular in combination with the specific geometry of the support structure and the mounting section with three respective mounting faces for corresponding arrangements of light emitting elements, the provision of the at least one first heat dissipation member is of particular advantage. On the one hand, by being of particular shape with increasing thickness away from the mounting section, the at least one first heat dissipation member supports and facilitates the function of the arrangements of light emitting elements to mimic a light distribution of a filament of a conventional halogen lamp. On the other hand, by being provided in close proximity with the light emitting elements, the at least one first heat dissipation member advantageously supports the function of the heat sink in guiding away heat generated by the light emitting elements. The at least one first heat dissipation member thus advantageously helps to solve the size problem of conventional LED retrofits disclosed above. In other words, the at least one first heat dissipation member advantageously enables arrangements of light emitting elements at particularly small mutual distances and thereby facilitates the function of the corresponding arrangements to mimic a light distribution of a conventional halogen lamp filament.

In an embodiment, the support structure comprises at least one mounting recess and wherein the at least one first heat dissipation member is a separate member received at least in part by the at least one mounting recess. As mentioned, providing the at least one first heat dissipation member as a separate component enables an advantageous flexibility in providing the at least one first heat dissipation member in accordance with the particular geometry of the arrangements of light emitting elements. In combination therewith, the mounting recess of the support structure advantageously contributes to a precise and reliable mounting of the at least one first heat dissipation member at the support structure.

In an embodiment, the mounting section comprises respective edge portions of a first and a second layer, the first and second layers being mutually insulated and respectively configured for electrically connecting at least a respective one of the arrangements of at least two light emitting elements. To this end, in an embodiment, the first and second layers comprise or essentially consist of a metallic material such as a metal, a metal mixture or alloy, having good electrical and thermal conductivity properties such as copper and/or aluminum. Thereby, essentially consisting of is to be understood as consisting predominantly of such metal (e.g. at least 90%) and possibly including further materials such as impurities or the like. In an embodiment, the first and second layers are essentially planar layers (which may be bent one or more times in accordance with an application) arranged mutually parallel and adjacent to each other and being separated by an insulating layer comprising e.g. a dielectric insulating material. In an embodiment, the central mounting face is formed by respective faces of both edge portions of the first and the second layer and the first lateral mounting face is comprised, in particular only and/or fully, by the first layer and the second lateral mounting face is comprised, in particular only and/or fully, by the second layer.

The provision of the lateral mounting faces on a respective one of the first and second layers advantageously allows for individually controlling the respective arrangements of light emitting elements. In addition, by arranging all of the light emitting elements on mounting faces comprised by members comprising or consisting of metal material, the first and second layers further advantageously allow for guiding heat generated by the light emitting elements away from the light emitting elements.

In an embodiment, the first and the second layers respectively comprise a printed circuit board, in particular an insulated metal substrate. For example, the first and the second layers may be respectively formed by one double sided or by two single sided insulated metal substrates (IMS), and the central mounting face corresponds in this case to an edge of the one double sided IMS or to respective adjacent edges of the two single sided IMSs. Use of printed circuit boards, in particular of insulated metal substrates, advantageously allows on the one hand to individuality control respective light emitting elements, and on the other hand advantageously facilitates heat transport away from the light emitting elements.

In an embodiment, the lighting device further comprises a second heat dissipation member arranged in between, in particular in direct mechanical contact with, the first and the second layer. For example, the second heat dissipation member may comprise or consist of a thin foil of a heat conductive material and may extend in between the first and the second layer to the heatsink to further support heat transport away from the light emitting elements. In an embodiment, the second heat dissipation member comprises a layer, in particular a foil, comprising carbon fiber. In an embodiment, the second heat dissipation member extends at least in part in between the first and the second layer to the heat sink and is in direct contact with the heat sink.

In an embodiment, the lighting device further comprises a third heat dissipation member arranged along an edge portion of the mounting section opposing the central mounting face. Thereby, the third heat dissipation member may extend towards the heat sink and may be directly connected with the heat sink. In an embodiment, the third heat dissipation member comprises at least one heat pipe arranged along respective edge portions of the first and the second layer. In an embodiment, the at least one heat pipe is at least partially filled with a fluid, in particular with water and/or air.

It turned out that in particular in combination with the particular geometry of the lighting device comprising three mounting faces for respective arrangements of light emitting elements, the combination of the at least one first, the second and the third heat dissipation members advantageously allows to efficiently guide away heat from the light emitting elements and thereby advantageously allows for closely arranging light emitting elements and thus contributes to solving the above-mentioned size problem of conventional LED retrofits. Thereby, all of the at least one first, the second and third heat dissipation members advantageously make use of the geometry that is given by the particular support structure such that for this particular geometry (in particular comprising the first and second layers) a heat transfer system is achieved which is optimized not only for heat guiding purposes but which advantageously facilitates and supports the light distribution properties of the lighting device.

In an embodiment, the lighting device according to the first aspect is a light source, e.g. a lamp, for example configured to be mounted to a lighting system, in particular to an automotive headlight. Different lighting systems include for example projector systems, a flashlight, etc. Being configured in this way, the lighting device may further comprise e.g. a suitable socket for mounting the lighting device to such lighting system.

The features and example embodiments of the invention described above may equally pertain to the different aspects according to the present invention. In particular, with the disclosure of features relating to the lighting device according to the first aspect, also corresponding features relating to the method according to the second aspect or to the automotive headlight according to the third aspect are disclosed.

It is to be understood that the presentation of embodiments of the invention in this section is merely exemplary and non-limiting.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and are merely intended to conceptually illustrate the structures and procedures described herein.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
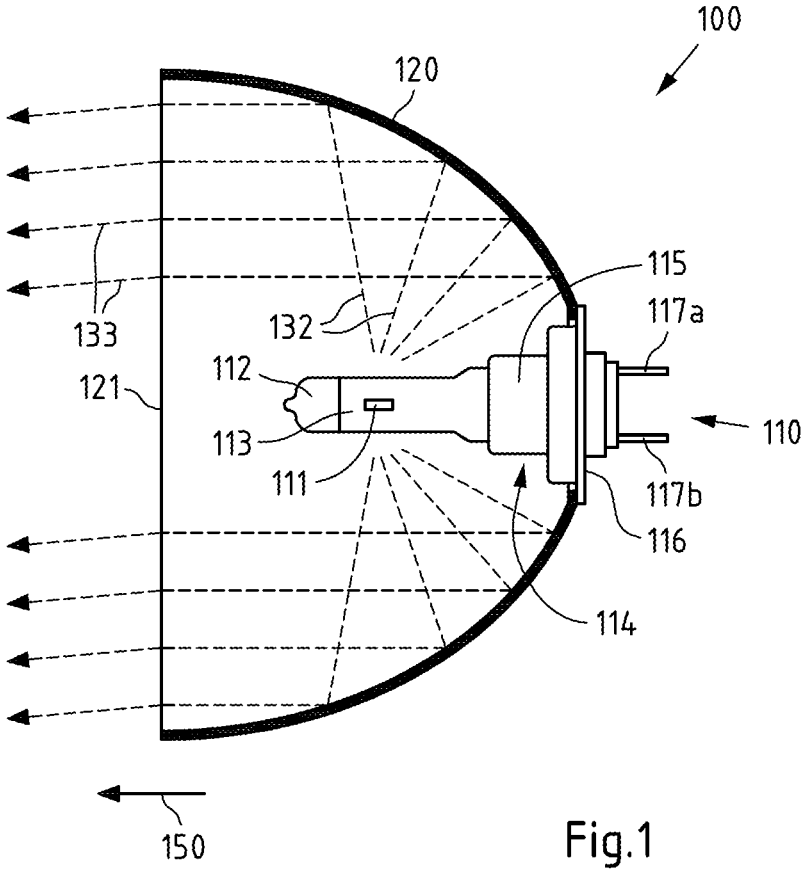
FIG. 1 illustrates a headlight with a conventional halogen lamp

FIG. 1 shows a headlight 100 with a reflector 120 to which an exemplary conventional H7 halogen lamp 110 is mounted. A filament 111 of halogen lamp 110 is placed at or near focus of reflector 120 such that light 132 emitted from filament 111 is reflected by the reflector 120 along a main lighting direction 150. A cover 121 may incorporate suitable optics for shaping the reflected light and to form light 133 leaving headlight 100. Lamp 110 comprises a socket 114 mounted to reflector 120 via mounting portion 116. Pins 117*a* and 117*b* extend from socket 114 for power connection. Bulb 113 extends from base portion 115 surrounding filament 111 and ends in a light blocking portion 112 which blocks direct light from filament 111.

Figure 2A:
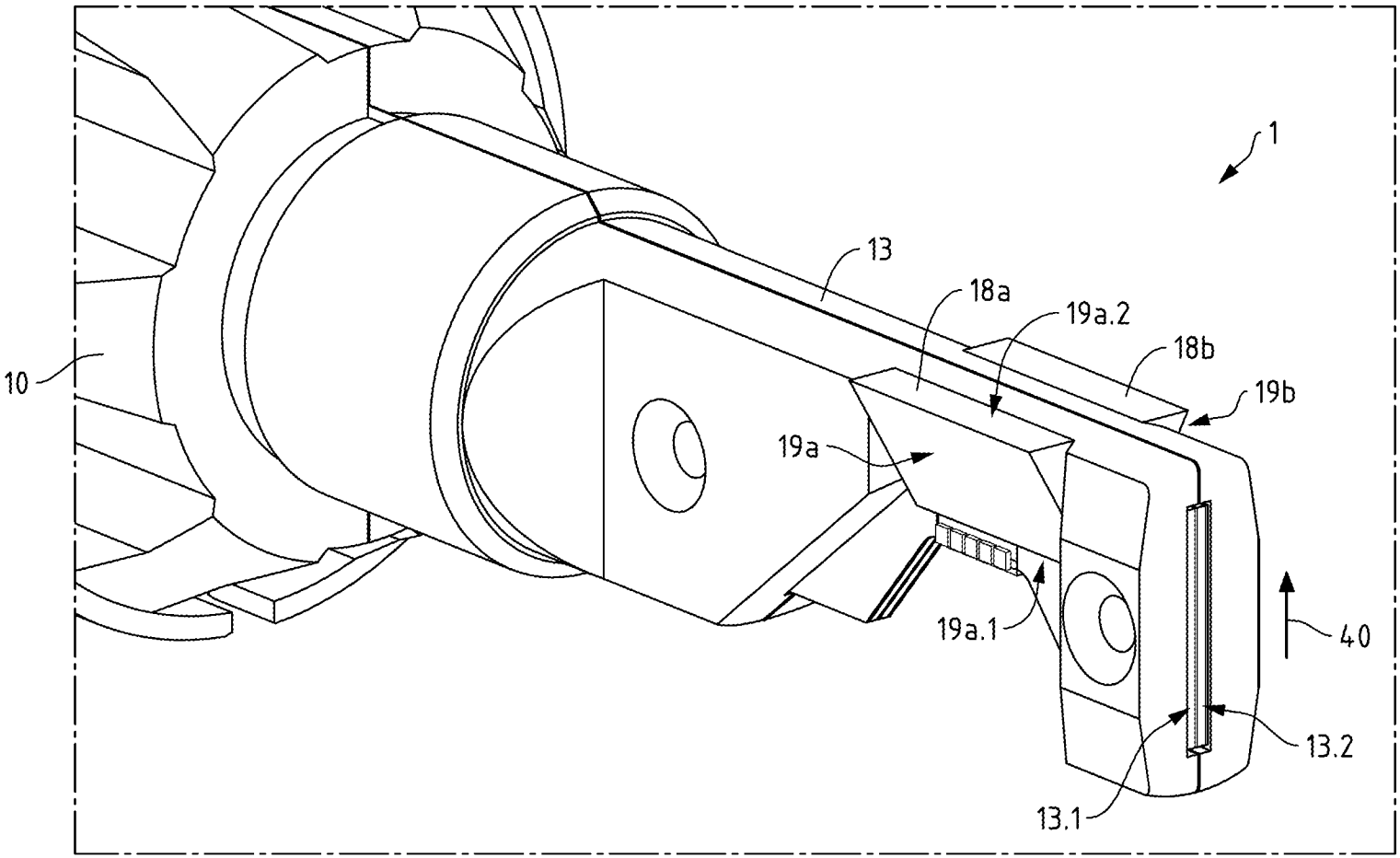
FIG. 2A illustrates a lighting device according to an embodiment.
Figure 2B:
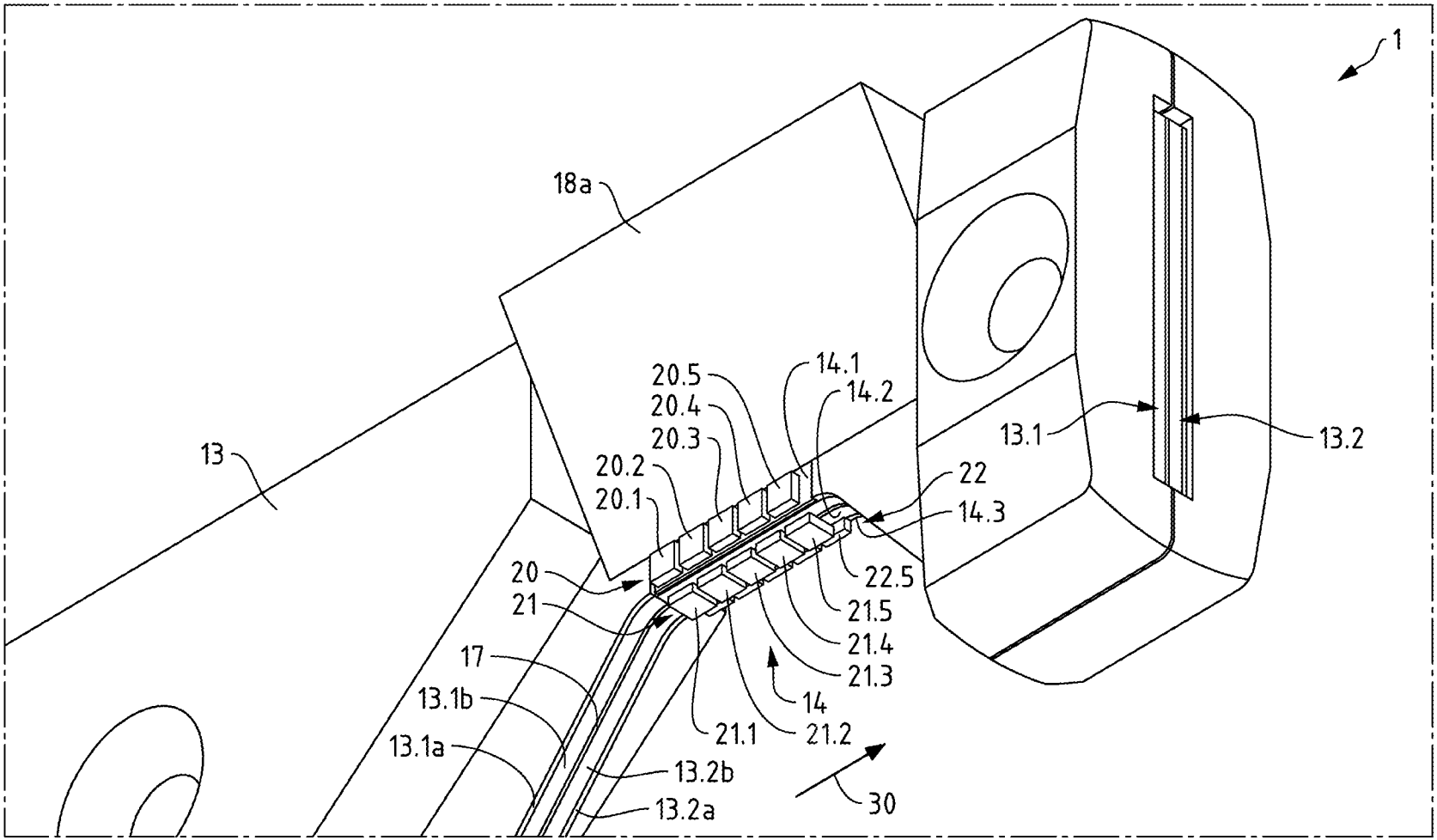
FIG. 2B exemplarily illustrates a detail of the lighting device according to FIG. 2A.
Figure 2C:
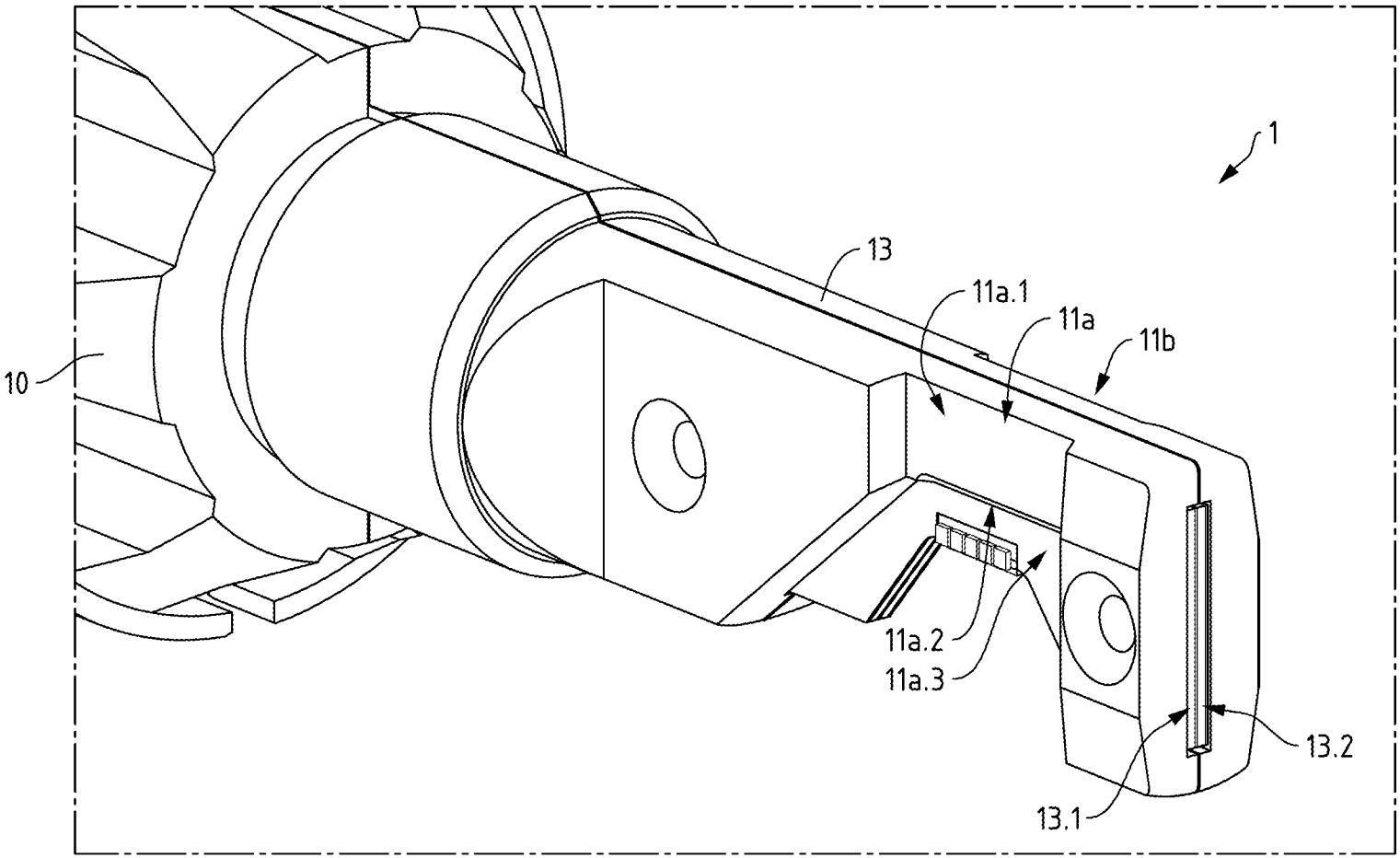
FIG. 2C illustrates the lighting device of FIG. 2A where first heat dissipation members have been removed.

FIGS. 2A, 2B and 2C show respective views of an exemplary lighting device 1 according to an embodiment of the invention. Specifically, FIG. 2A shows a three-dimensional view of part of the lighting device 1 where two first heat dissipation members 18*a*, 18*b* are mounted to respective mounting recesses 11*a*, 11*b* and FIG. 2C shows a three-dimensional view of the part of the lighting device 1 of FIG. 2A where the heat dissipation members 18*a*, 18*b* are not mounted to respective mounting recesses 11*a*, 11*b*. FIG. 2B shows mounting section 14 of the lighting device 1 of FIGS. 2A and 2C in detail.

Lighting device 1 is an example of an LED (light emitting diode) retrofit to be, for example, connected to a corresponding automotive headlight (not shown). Replacing bulb 113 and filament 111 of FIG. 1, lighting device 1 comprises a support structure 13 and arrangements 20, 21 and 22 of light emitting diodes (LEDs) which are examples of light emitting elements. Support structure 13 extends from a heat sink 10, which may comprise, be connected to, and/or correspond to a socket (not shown in the figure) for mounting lighting device 1 to the headlight.

FIG. 2B illustrates support structure 13 comprising a mounting section 14 with a central mounting face 14.2 and first and second lateral mounting faces 14.1, 14.3. The first lateral mounting face 14.1 and the second lateral mounting face 14.3 are each directly adjacent to the central mounting face 14.2 and each form an angle of 90°±5° with the central mounting face 14.2. A first arrangement 21 of LEDs 21.1, 21.2, 21.3, 21.4, and 21.5 is arranged along mounting direction 30 on the central mounting face 14.2. A second arrangement 20 of LEDs 20.1, 20.2, 20.3, 20.4, and 20.5 is arranged along the mounting direction 30 on the first lateral mounting face 14.1. A third arrangement 22 of LEDs 22.1, 22.2, 22.3, 22.4, and 22.5 is arranged along the mounting direction 30 on the second lateral mounting face 14.3 (for purposes of clarity, only LED 22.5 is labelled in the FIG. 2B, but LEDs 22.1, 22.2, 22.3, and 22.4 are illustrated behind the first arrangement 21).

Turning back to FIG. 2A, two first heat dissipation members 18*a*, 18*b* are mounted to respective mounting recesses 11*a*, 11*b* (see FIG. 2C) of the support structure 13, the first heat dissipation members 18*a*, 18*b* being separate members. In an embodiment, the first heat dissipation members 18*a*, 18*b* are made of copper. Separated first heat dissipation members 18*a*, 18*b* of copper give the advantage of particularly beneficial heat transport capability usable in close proximity with the heat sources (the LEDs), while a generally cheaper material of less heat transport capability such as aluminum may be used as material of heat sink 10.

First heat dissipation members 18*a*, 18*b* respectively extend from an outer face 11*a*.1, 11*a*.2, 11*a*.3 (see FIG. 1C) of the support structure 13 and respectively comprise an inclined surface 19*a*, 19*b* which is inclined with respect to a respective one of the first and the second lateral mounting faces 14.1, 14.3 from which the respective first heat dissipation members 18*a*, 18*b* extend. A thickness of the at least one first heat dissipation member 18*a*, 18*b* thus increases along second direction 40 away from the mounting section 14. The second direction 40 may be perpendicular to the mounting direction. In other words, for example, inclined surface 19*a* extends from proximal edge 19*a*.1 of first heat dissipation member 18*a* to a distal edge 19*a*.2 of first heat dissipation member 18*a*, first heat dissipation member 18*a* comprising an essentially triangular cross-section (when viewed from the mounting direction) with one corner of the triangular cross-section being formed by proximal edge 19*a*.1 and with a side of the triangular cross-section opposing said corner forming the distal edge 19*a*.2. A side of the triangular cross-section of first heat dissipation member 18*a* in contact with support structure 13 is thus matched in shape with the first surface portion 11*a*.1, with step 11*a*.2 and with the second surface portion 11*a*.3. In this way, first heat dissipation member 18*a* is mounted precisely and reliably, allowing first heat dissipation member 18*a* to be arranged essentially adjacent to the second arrangement 20 of LEDs 20.1, 20.2, 20.3, 20.4, and 20.5 arranged on the first lateral mounting face 14.1.

The first heat dissipation members 18*a*, 18*b* advantageously allow for heat to be trans-ported away from the LEDs mounted to mounting section 14. For example, if the lighting device 1 is operated without the first heat dissipation members 18*a*, 18*b* (such as shown in FIG. 2C), respective temperatures of the LEDs 20.1, 20.2, 20.3, 20.4, and 20.5 of the second arrangement 20 are 99.04° C., 110.41° C., 113.49° C., 111.38° C. and 97.56° C. These temperatures are reduced to 92.96° C., 101.37° C., 103.75° C., 101.95° C. and 92.39° C. upon same operation conditions when first heat dissipation members 18*a*, 18*b* are mounted to support structure 13. In other words, a particular temperature of the central LED 20.3 which becomes hottest upon operation is reduced by about 10° C. as a result of the first heat dissipation members 18*a*, 18*b*. Thus, by only adding first heat dissipation members 18*a*, 18*b*, the function of an existing heat sink can be advantageously improved.

Turning back to FIG. 2B, mounting section 14 comprises respective edge portions of a first layer 13.1 and of a second layer 13.2, which are mutually insulated by a dielectric insulation layer 17. First and second layers 13.1 and 13.2 respectively correspond to insulated metal substrates (IMSs), respectively including further layers 13.1*a*, 13.1*b*, 13.2*a* and 13.2*b* which may serve to provide respective polarities for suitably contacting LEDs of the arrangements 20, 21 and 22 of LEDs. Thereby, the central mounting face 14.2 is formed by respective faces of both edge portions of the first and the second layers 13.1, 13.2, the first lateral mounting face 14.1 is fully comprised by the first layer 13.1, and the second lateral mounting face 14.3 is fully comprised by the second layer 13.2.

Figure 3:
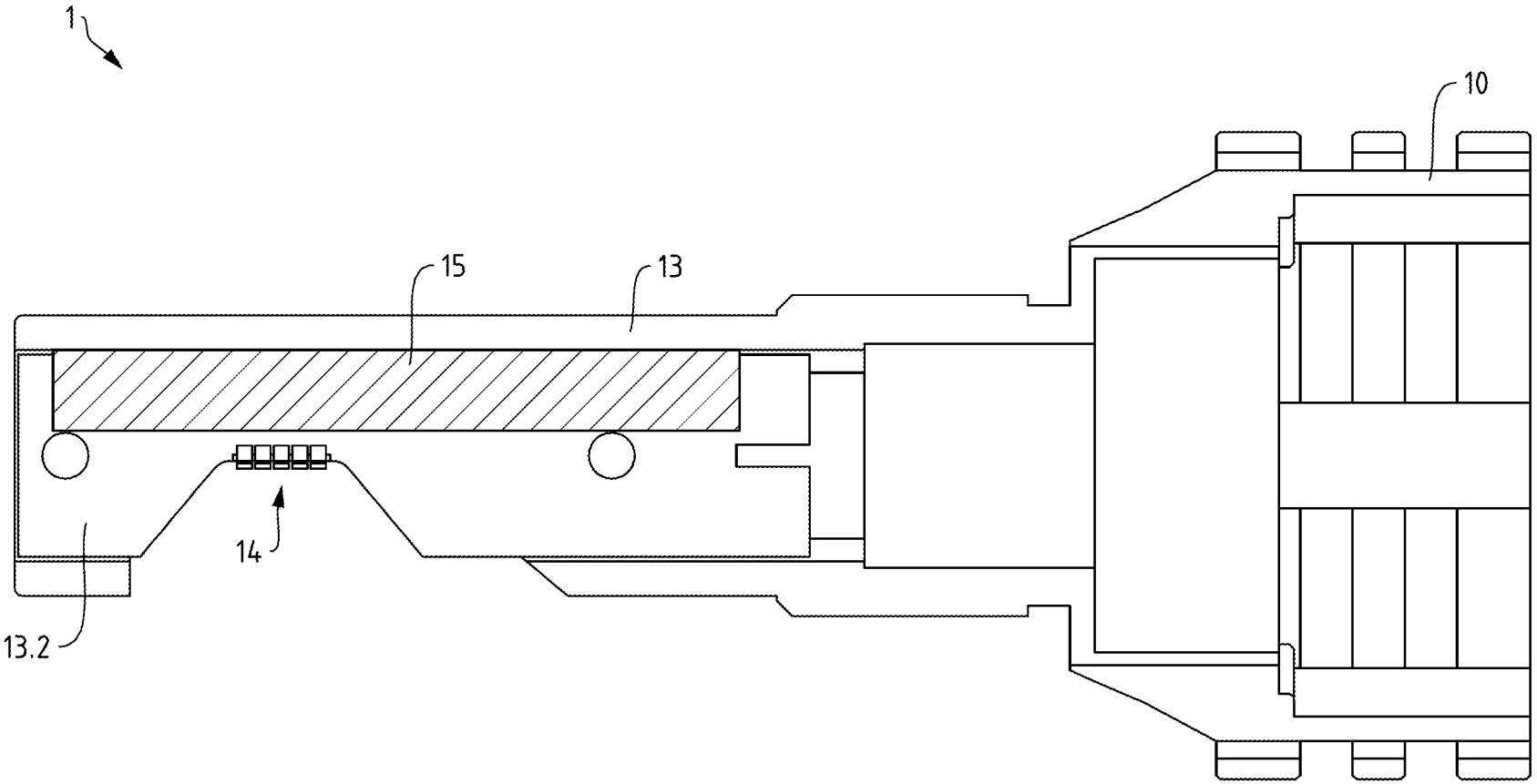
FIG. 3 illustrates a part of a lighting device according to an embodiment.

FIG. 3 depicts, in an embodiment, a cross-section of support structure 13 advantageously allowing for insertion of a second heat dissipation member 15 in the form of a thin foil of carbon fiber in between the first and second layers 13.1, 13.2 of support structure 13. The cross-section depicted in FIG. 3 is seen in a third direction that may be perpendicular to the mounting direction 30 and the direction 40. The second heat dissipation member 15 may be in direct contact with each of the first and second layers 13.1, 13.2. The second heat dissipation member 15 is shown FIG. 3 to be mounted on the second layer 13.2. In an embodiment, the second heat dissipation member 15 covers only part of the area of second layer 13.2, and part of the area of first layer 13.1 The second heat dissipation member 15 may further extend and may be mechanically connected to heat sink 10 to further support transport of heat from the LEDs to heat sink 10.

Figure 4:
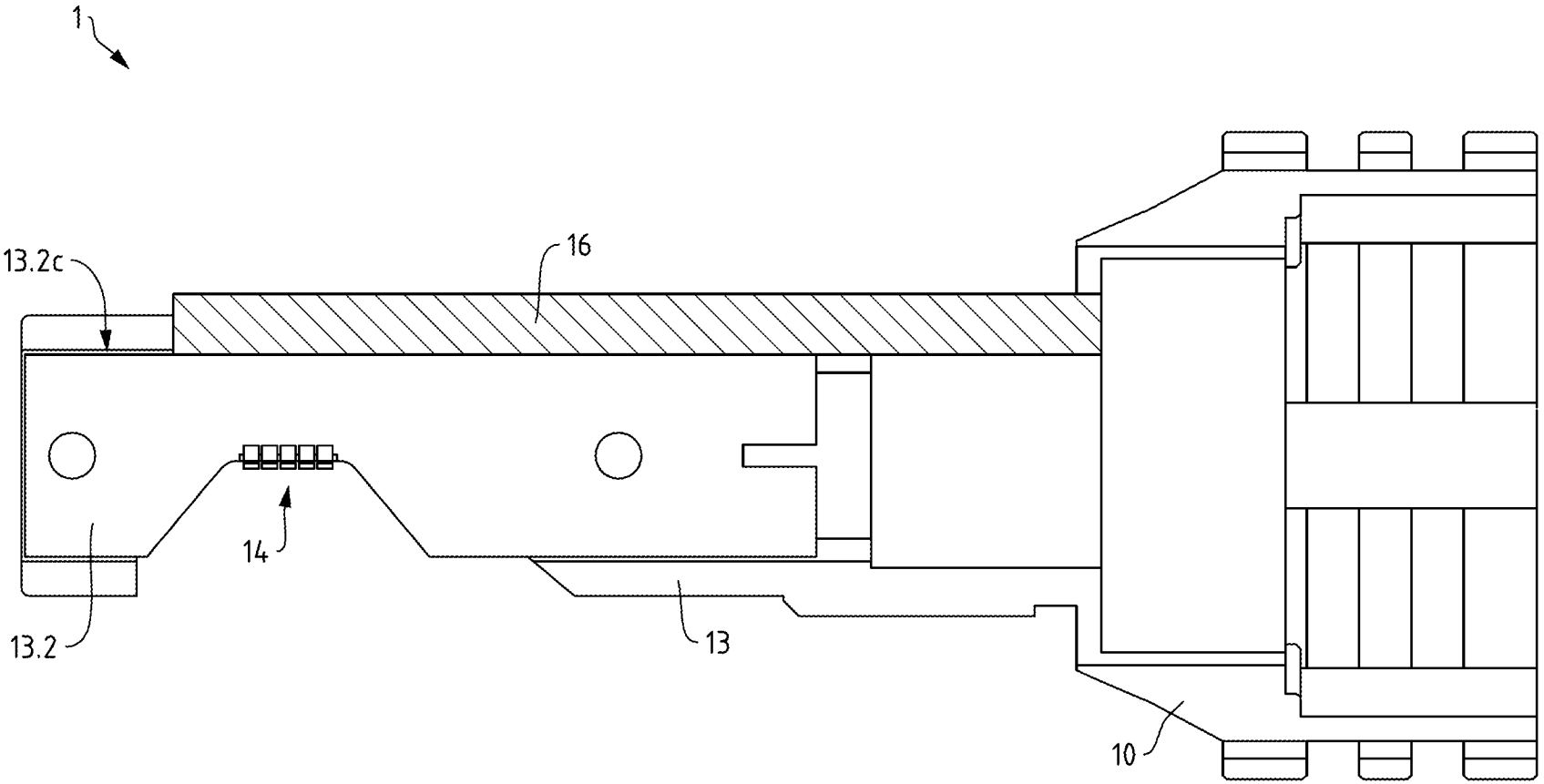
FIG. 4 illustrates a part of a lighting device according to an embodiment.

FIG. 4 depicts, in an embodiment, a cross-section of support structure 13 with a third heat dissipation member 16 in the form of a heat pipe. The heat pipe 16 is arranged along an edge portion of mounting section 14 opposing the central mounting face 14.2, i.e., along respective edge portions 13.1*c*, 13.2*c* of the first and second layers 13.1, 13.2 (first layer 13.1 and its edge portion 13.1*c* not shown for better visibility of remaining parts). The heat pipe 16 may be in direct contact with both of the first and second layers 13.1, 13.2 via the respective edge portions 13.1*c*, 13.2*c*. As illustrated, the heat pipe 16 may not overlap any area of the first and the second layers 13.1, 13.2 along the third direction from which FIG. 4 depicts the cross-section of support structure 13. Heat pipe 16 is in mechanical and thermal connection with heat sink 10 to further support heat transport. While heat pipe 16 may be provided with a circular cross-section, in an embodiment, at least one outer face of heat pipe 16 which is in contact with support structure 13 and/or the first and/or the second layer 13.1, 13.2 is flat. Thereby, a particularly advantageous thermal contact between heat pipe 16 and/or the support structure 13 and/or the first and/or the second layer 13.1, 13.2 is enabled. To this end, for example, in an embodiment, heat pipe 16 comprises a triangular or polygonal cross-section when viewed from the mounting direction.

| LIST OF REFERENCE SIGNS: | |
|---|---|
| Lighting device | 1 |
| Heat sink | 10 |
| Mounting recesses | 11a, 11b |
| Outer face (First surface portion, Step, Second surface portion) | 11a.1, 11a.2, 11a.3 |
| Support structure | 13 |
| First layer | 13.1 |
| Second layer | 13.2 |
| Edge portions of first and second layers | 13.1c, 13.2c |
| Further layers of first and second layer | 13.1a, 13.1b, 13.2a, 13.2b |
| Mounting section | 14 |
| First lateral mounting face | 14.1 |
| Central mounting face | 14.2 |
| Second lateral mounting face | 14.3 |
| Second heat dissipation member | 15 |
| Third heat dissipation member | 16 |
| Dielectric insulation layer | 17 |
| First heat dissipation members | 18a, 18b |
| Inclined surfaces | 19a, 19b |
| Proximal edge of the first heat dissipation member | 19a.1 |
| Distal edge of the first heat dissipation member | 19a.2 |
| Second arrangement of at least two light emitting elements | 20 |
| LEDs of second arrangement | 20.1, 20.2, 20.3, 20.4, 20.5 |
| First arrangement of at least two light emitting elements | 21 |
| LEDs of first arrangement | 21.1, 21.2, 21.3, 21.4, 21.5 |
| Third arrangement of at least two light emitting elements | 22 |

-continued

| LIST OF REFERENCE SIGNS: | |
|---|---|
| LEDs of third arrangement | 22.1, 22.2, 22.3, 22.4, 22.5 |
| Mounting direction | 30 |
| Second direction | 40 |
| Headlight | 100 |
| Halogen lamp | 110 |
| Filament | 111 |
| Light blocking portion | 112 |
| Bulb | 113 |
| Socket | 114 |
| Base portion | 115 |
| Mounting portion | 116 |
| Pins | 117a, 117b |
| Reflector | 120 |
| Cover | 121 |
| Light rays | 132, 133 |
| Main lighting direction | 150 |

The invention claimed is:

1. A lighting device comprising:

a support structure extending in a first direction from a heat sink and comprising a mounting section that has a central mounting face and first and second lateral mounting faces, a first surface portion different from the mounting section, each of the first and second lateral mounting faces being adjacent to the central mounting face and forming an angle with the central mounting face;

a first arrangement of at least two light emitting elements arranged along the first direction on the central mounting face;

a second arrangement of at least two light emitting elements arranged along the first direction on the first lateral mounting face;

a third arrangement of at least two light emitting elements arranged along the first direction on the second lateral mounting face; and at least one first heat dissipation member in direct contact with and extending from the first surface portion of the support structure, the at least one first heat dissipation member comprising an inclined surface inclined at a non-perpendicular angle with respect to the first surface portion and a respective one of the first and the second lateral mounting faces of the support structure such that a respective thickness of the at least one first heat dissipation member increases away from the first surface portion along a second direction perpendicular to the first direction.

2. The lighting device according to claim 1, wherein a proximal edge of the at least one first heat dissipation member is arranged essentially adjacent to the second or third of at least two light emitting elements corresponding to the respective one of the first and the second lateral mounting faces.

3. The lighting device according to according to claim 2, wherein the first surface portion is separated from a second surface portion of the support structure by a step, the second surface portion comprises the respective one of the first and the second lateral mounting faces, and the proximal edge of the at least one first heat dissipation member is arranged on the second surface portion.

4. The lighting device according to claim 3, wherein the inclined surface extends from the proximal edge of the at least one first heat dissipation member to a distal edge of the at least one first heat dissipation member, the at least one first heat dissipation member comprises an essentially triangular cross-section with one corner of the triangular cross-section being formed by the proximal edge and with a side of the triangular cross-section opposing said one corner forming the distal edge.

5. The lighting device according to claim 1, wherein the support structure comprises at least one mounting recess and the at least one first heat dissipation member is a separate member received at least in part by the at least one mounting recess.

6. The lighting device according to claim 1, wherein the mounting section comprises respective edge portions of a first and a second layer, the first and second layers being mutually insulated and respectively configured for electrically connecting at least a respective one of the first, second, and third arrangements of at least two light emitting elements.

7. The lighting device according to claim 6, wherein the central mounting face is formed by respective faces of both edge portions of the first and the second layer, the first lateral mounting face being comprised by the first layer, and the second lateral mounting face being comprised by the second layer.

8. The lighting device according to claim 7, wherein the first and the second layers respectively comprise a printed circuit board that is an insulated metal substrate.

9. The lighting device according to claim 7, further comprising a second heat dissipation member arranged in between the first and the second layer.

10. The lighting device according to claim 9, wherein the second heat dissipation member is in direct contact with the first and the second layer.

11. The lighting device according to claim 9, wherein the second heat dissipation member partially but does not entirely overlap respective the first and the second layer along a third direction perpendicular to the first direction and the second direction.

12. The lighting device according to claim 9, wherein the second heat dissipation member comprises a layer comprising carbon fiber.

13. The lighting device according to claim 7, further comprising a third heat dissipation member arranged along an edge portion of the mounting section opposing the central mounting face.

14. The lighting device according to claim 13, wherein the third heat dissipation member comprises at least one heat pipe arranged along respective edge portions of the first and the second layer.

15. The lighting device according to claim 13, wherein the third heat dissipation member comprises at least one heat pipe with a triangular, circular, or polygonal cross-section.

16. The lighting device according to claim 13, wherein the third heat dissipation member is in direct contact with the first and the second layer.

17. The lighting device according to claim 13, wherein the third heat dissipation member does not overlap the first and the second layer along a third direction perpendicular to the first direction and the second direction.

18. The lighting device according to claim 1, wherein the first and the second lateral mounting faces are arranged to be mutually parallel and to form an angle of 90°±5° with the central mounting face.

19. A method of manufacturing the lighting device of claim 1, the method comprising:

providing a support structure extending in a first direction from the heat sink and comprising a mounting section with a central mounting face and the first and second lateral mounting faces, each of the first and second lateral mounting faces being adjacent to the central mounting face and forming an angle with the central mounting face;

providing a first arrangement of at least two light emitting elements arranged along the first direction on the central mounting face;

providing the second arrangement of at least two light emitting elements arranged along the first direction on the first lateral mounting face;

providing the third arrangement of at least two light emitting elements arranged along the mounting direction on the second lateral mounting face; and providing the at least one first heat dissipation member extending from the first surface portion, of the support structure and comprising the inclined surface, the inclined surface inclined with respect to a respective one of the first and the second lateral mounting faces of the support structure such that a respective thickness of the at least one first heat dissipation member increases away from the mounting section along a second direction perpendicular to the first direction.

20. An automotive headlight comprising the lighting device according to claim 1.

* * * * *